United States Patent [19]

Zoland

[11] 4,141,399

[45] Feb. 27, 1979

[54] EXPANDABLE BAG WITH INTERNAL BIASING MEANS

[76] Inventor: Martin Zoland, 76 Raglan St., Preston, Melbourne, Australia, 3072

[21] Appl. No.: 857,392

[22] Filed: Dec. 5, 1977

[51] Int. Cl.[2] ..... A45C 7/00

[52] U.S. Cl. ..... 150/31; 190/43; 190/50; 206/526

[58] Field of Search ..... 150/31, 28 R, 35, 1, 150/3; 190/43, 44; 206/499, 554, 526

[56] References Cited

U.S. PATENT DOCUMENTS

| | | | |
|---|---|---|---|
| 1,045,510 | 11/1912 | Campbell | 150/2.7 X |
| 1,051,716 | 1/1913 | Eiseman | 150/31 |
| 2,024,908 | 12/1935 | Blum | 150/2.7 |
| 2,151,999 | 3/1939 | Stember | 150/10 |
| 2,798,579 | 7/1957 | Fox | 190/43 |
| 3,338,398 | 8/1967 | Altman | 206/499 |

*Primary Examiner*—Donald F. Norton

*Attorney, Agent, or Firm*—Ostrolenk, Faber, Gerb & Soffen

[57] ABSTRACT

An expandable bag having a closure and insert in said bag, said insert comprising a pair of parallel sheet members, a first means biasing said parallel sheet members apart, and restraining means external to the bag and operable maintain the sheet members relatively closely spaced and the bag in a collapsed state whereupon, on removal of the restraining means, the biasing means cause the sheet members to move apart, whereby the bag is expanded.

5 Claims, 5 Drawing Figures

EXPANDABLE BAG WITH INTERNAL BIASING MEANS

The invention relates to an apparatus for permitting the shipment of flexible sided bags such as cosmetic bags, purses, soft-sided luggage and handbags in a flattened condition with means provided within the bag by which the bag may be expanded to present an attractive appearance at the point of sale. In shipping of merchandise, freight payments are made, not only with respect to weight, but also with respect to volume. By providing a device which may be inserted in the bag at the point of manufacture, and may be expanded at the point of display the bag may be shipped flat and erected for a suitable attractive appearance at the point of sale.

According to the present invention there is provided an expandable bag having a closure and insert in said bag, said insert comprising a pair of parallel sheet members, a first means biasing said parallel sheet members apart, and restraining means external to the bag and operable to maintain the sheet members relatively closely spaced and the bag in a collapsed state whereupon, on removal of the restraing means, the biasing means cause the sheet members to move apart whereby the bag is expanded.

The biasing means can take a number of forms. It may for example be a helical compression spring or a leaf spring or other expanding device. A helical spring may be most appropriate, because this can provide a large ratio between compressed and expanded sizes and can also provide a relatively large expanding thrust.

In the following description, the biasing means will be referred to as a spring. This is simply for convenience of description and is to be understood as not limiting the type of biasing means to be chosen.

Preferably a flat card will be mounted on each side of the spring, so that the card lies in a plane at right angles to the direction of expansion. The spring will preferably be attached to the card on each side: for example, two projections on each end of the spring engage in corresponding holes in the cards in order to maintain the spring in the correct position. The cards obviously should be of smaller dimensions than the internal dimensions of the bag, so that they can be inserted and the bag closed. The cards may, in fact, be considerably smaller than the bag, and a limited range of card sizes may be used over a large range of bag sizes. The cards need not be the same size on opposite sides of the spring. The larger card would then locate the spring in the correct position in the bag and the smaller card would provide a contact area for pushing a side of the bag outwards.

The invention will now be described with reference to the accompanying drawings, in which.

Figure 1:
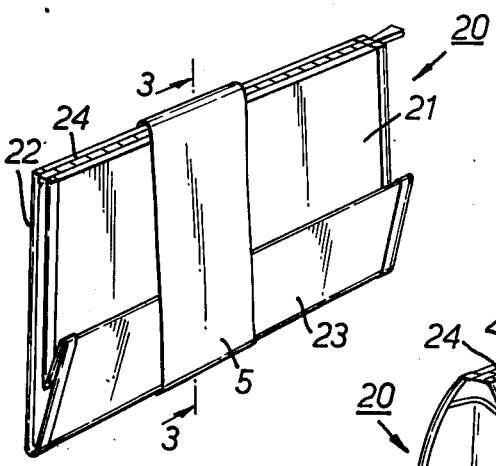
FIG. 1 is a view in perspective of a single cosmetic bag constructed in accordance with the invention, and arranged for flat packing for shipment.
Figure 2:
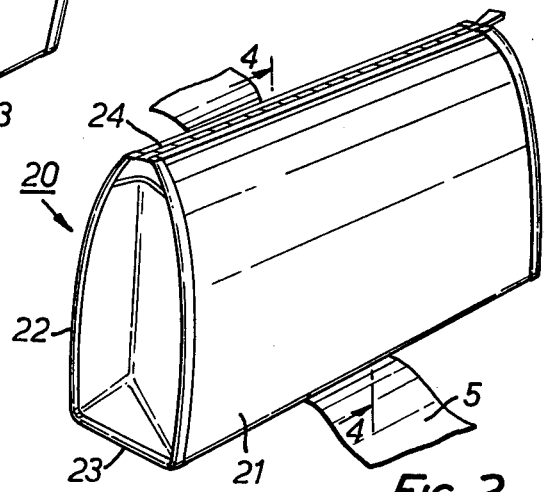
FIG. 2 is a view in perspective, corresponding to FIG. 1 showing the same cosmetic bag fully expanded.
Figure 3:
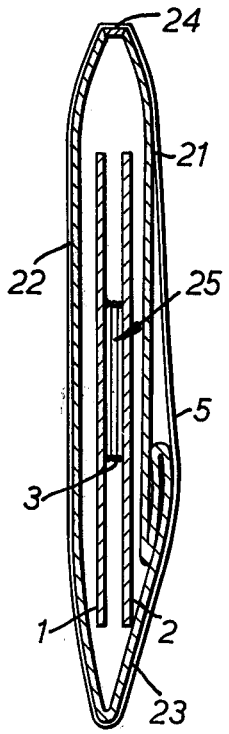
FIG. 3 is a cross-sectional view taken on line 3—3 of FIG. 1 looking in the direction of the arrows and showing the insert member collapsed aand ready for expansion.
Figure 4:
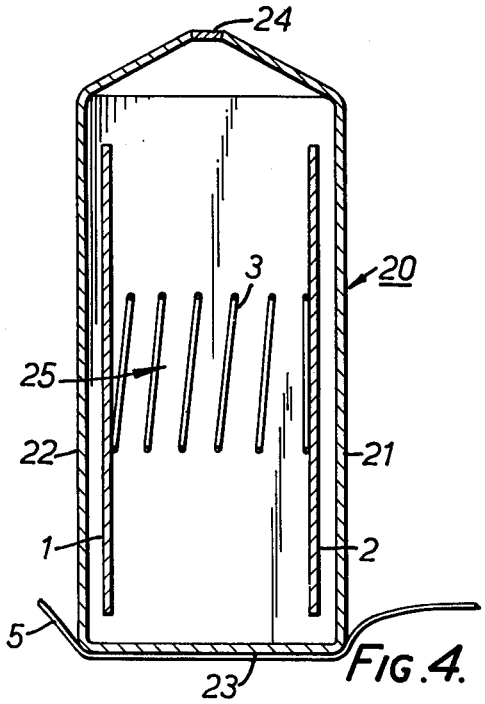
FIG. 4 is a cross-sectional view taken on line 4—4 of FIG. 2 looking in the direction of the arrows and showing the insert member fully expanded in order to expand the bag from the position of FIG. 1 to the position of FIG. 2.
Figure 5:
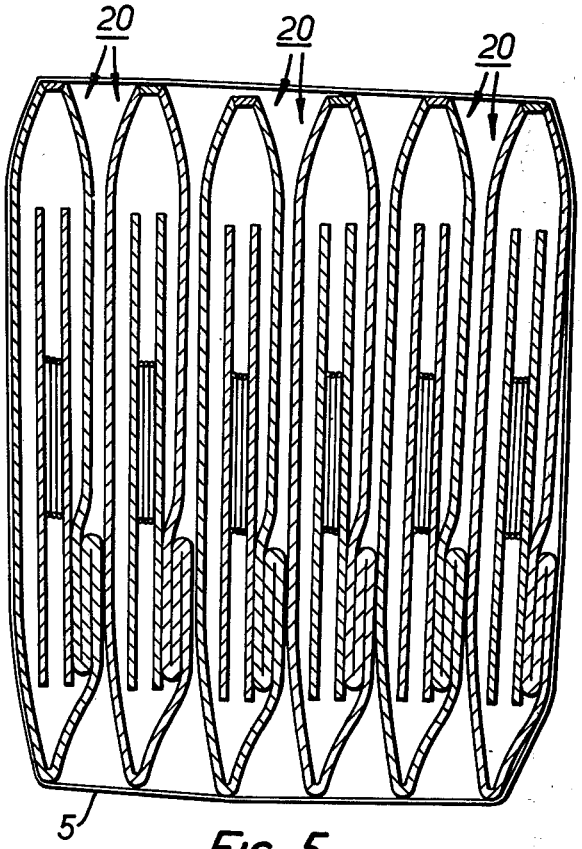
FIG. 5 is a similar view to FIG. 3 but illustrating a bundle of bags packed ready for shipment.

Referring now more specifically to the drawings, FIG. 1 shows a cosmetic bag 20 having sidewalls 21 and 22 and a bottom flap 23 as well as a top closure 24. An expanding device 25 is located within the bag and comprises of two cards 1 and 2 and a compression spring 3 is located between the cards 1 and 2 and has its ends affixed to respective cards by means of adhesive tape (not shown). The spring is held compressed by means of a strip of paper 5 extending about the collapsed bag 20 and upon breaking the strip 5 the spring 3 expands the bag 20 to its expanded condition as seen in FIGS. 2 and 4. The bag 20 may be sealed within a protective polythene bag (not shown) and in that case the strip 5 would be exterior to the polythene bag. FIG. 5 shows a cross-sectional view through a bundle of six bags 20 packed in accordance with the invention. In this arrangement a single strip 5 extends about all six bags.

Many modifications would be apparent to those skilled in the art. For instance, more than one spring can be used. If the bag to be expanded is large, this may be particularly appropriate.

The invention is not limited in its application to bags. It may be used in other hollow collapsible articles, where it is desired to store the articles flat, but to expand them for display.

In an alternative further embodiment, it is envisaged that frames of a material such as polystyrene or low density polyethylene could be used instead of cards.

I claim:

1. An expandable bag having a closure and insert in said bag, said insert comprising a pair of parallel sheet members, a first means biasing said parallel sheet members apart, and restraining means external to the bag and operable to maintain the sheet members relatively closely spaced and the bag in a collapsed state whereupon, on removal of the restraining means, the biasing means cause the sheet members to move apart, whereby the bag is expanded.

2. A bag as claimed in claim 1 wherein the biasing means comprises a compression spring and the sheet members comprise cardboard.

3. A bag as claimed in claim 2 wherein the ends of the spring are affixed to respective sheet members.

4. A bag as claimed in claim 1 wherein the restraining means comprises a strip of paper extending around the bag.

5. A bundle of bags as defined in claim 4 wherein the strip extends around all of the bags.

* * * * *